US008752334B1

(12) United States Patent
Vanduch et al.

(10) Patent No.: US 8,752,334 B1
(45) Date of Patent: Jun. 17, 2014

(54) SLIDING DOOR GRIPPING APPARATUS

(76) Inventors: Jeren J. Vanduch, Brookings, SD (US); Virginia J. Thomson, Brookings, SD (US)

( * ) Notice: Subject to any disclaimer, the term of this patent is extended or adjusted under 35 U.S.C. 154(b) by 737 days.

(21) Appl. No.: 12/264,614

(22) Filed: Nov. 4, 2008

(51) Int. Cl.
*E05B 1/00* (2006.01)

(52) U.S. Cl.
USPC ..... 49/460; 49/70; 16/422; 16/901

(58) Field of Classification Search
USPC ..... 49/460, 70; 16/422, 426, 901, 430
See application file for complete search history.

(56) References Cited

U.S. PATENT DOCUMENTS

| | | | | | |
|---|---|---|---|---|---|
| 1,705,221 | A | * | 3/1929 | Jones | 294/187 |
| 2,131,687 | A | * | 9/1938 | Kaplan | 294/187 |
| 2,319,727 | A | | 5/1943 | Duggan | |
| 2,871,054 | A | * | 1/1959 | Zinke | 294/187 |
| D190,627 | S | | 6/1961 | Miller | |
| 3,280,422 | A | | 10/1966 | Hoffmann | |
| 4,893,435 | A | | 1/1990 | Shalit | |
| 5,087,005 | A | * | 2/1992 | Holoff et al. | 248/205.8 |
| 5,469,661 | A | | 11/1995 | Finkelstein et al. | |
| 5,555,779 | A | | 9/1996 | Holden | |
| 5,927,018 | A | | 7/1999 | Thain | |
| 6,067,690 | A | * | 5/2000 | Herman | 16/412 |
| 6,154,929 | A | * | 12/2000 | Dwyer | 16/422 |
| 6,289,557 | B1 | * | 9/2001 | Manson et al. | 16/412 |
| 6,360,488 | B1 | | 3/2002 | Darling | |
| 6,478,271 | B1 | | 11/2002 | Mulholland | |
| D510,853 | S | * | 10/2005 | Liao | D8/354 |
| 7,043,799 | B2 | * | 5/2006 | Moody | 16/412 |

* cited by examiner

*Primary Examiner* — Katherine Mitchell
*Assistant Examiner* — Catherine A Kelly
(74) *Attorney, Agent, or Firm* — The Law Firm of Andrea Hence Evans, LLC

(57) ABSTRACT

A sliding door gripping apparatus includes a base that includes a first side and a second side. The first side is concavely arcuate. A panel is attached to and extends away from the second side. A suction cup is removably attachable to a glass surface of a sliding door. A coupling assembly couples the suction cup to the first side of the base to allow the suction cup to attach the panel to the sliding door. The suction cup is pulled toward the first side of the base when the base is rotated in a first direction with respect to the suction cup to increase adhesion between the suction cup and the sliding door when the suction cup is attached to the glass surface. The panel is abuttable by a person's appendage to open the sliding door when the suction cup is attached to the sliding door.

5 Claims, 6 Drawing Sheets

SLIDING DOOR GRIPPING APPARATUS

BACKGROUND OF THE INVENTION

Field of the Invention

The present invention relates to sliding door grip devices and more particularly pertains to a new sliding door grip device for allowing a person to open a sliding door with a foot, elbow or other portion of their body if they are unable to use their hands to grip a handle of the door.

SUMMARY OF THE INVENTION

The present invention meets the needs presented above by generally comprising a base that includes a first side, a second side and a perimeter edge. The first side is concavely arcuate. A panel is attached to and extends away from the second side of the base. A suction cup is removably attachable to a glass surface of a sliding door. A coupling assembly couples the suction cup to the first side of the base to allow the suction cup to attach the panel to the sliding door. The coupling assembly includes a first mating member attached to the first side and a second mating member attached to the suction cup. The first and second mating members are threadably coupled to each other. The suction cup is pulled toward the first side of the base when the base is rotated in a first direction with respect to the suction cup to increase adhesion between the suction cup and the sliding door when the suction cup is attached to the glass surface. The panel is abuttable by a person's appendage to open the sliding door when the suction cup is attached to the sliding door.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
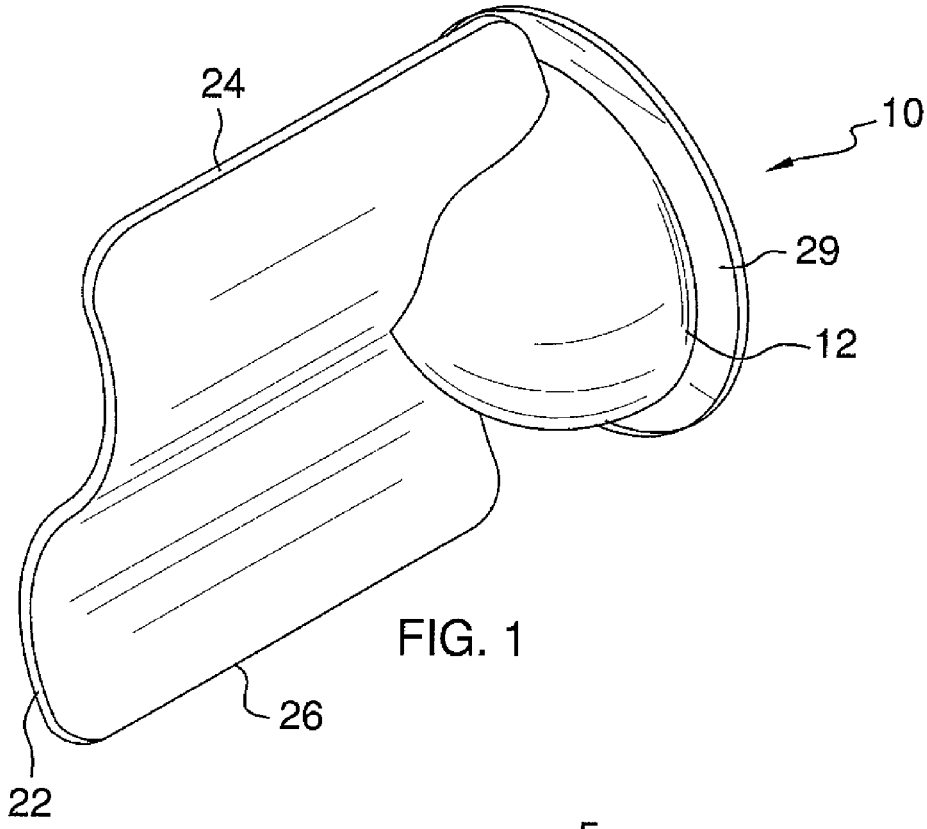
FIG. 1 is a front perspective view of a sliding door gripping apparatus according to the present invention.
Figure 2:
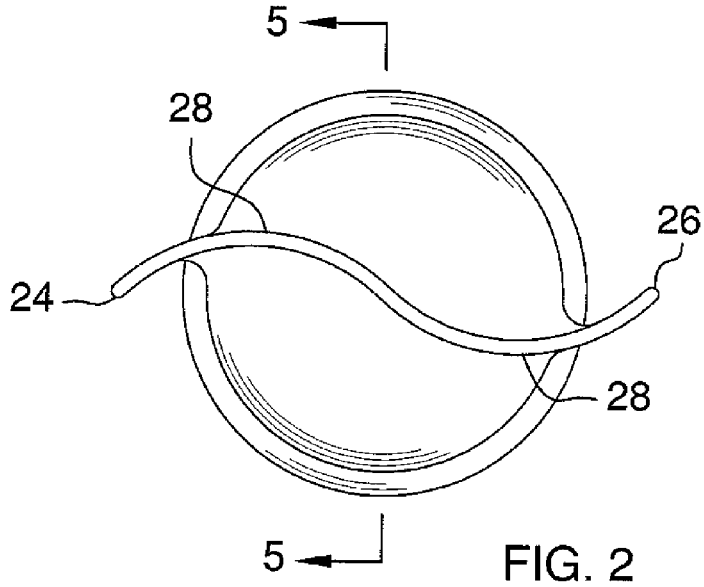
FIG. 2 is a front view of the present invention.
Figure 3:
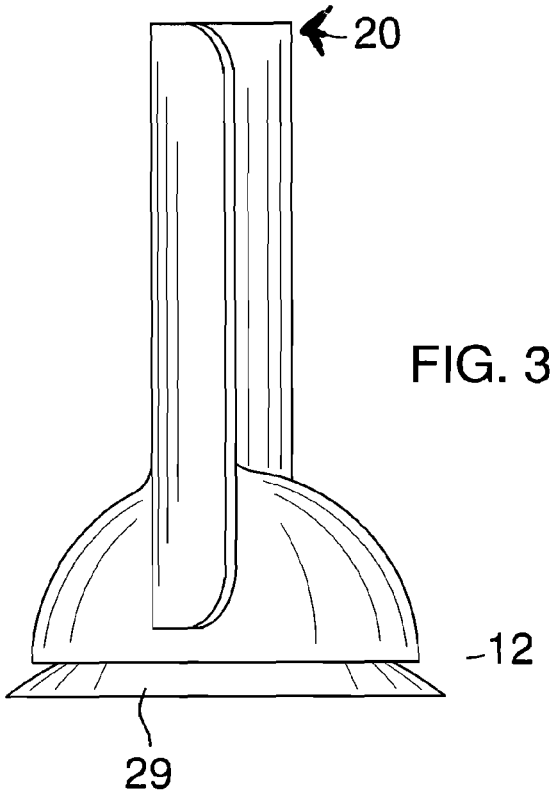
FIG. 3 is a bottom view of the present invention.
Figure 4:
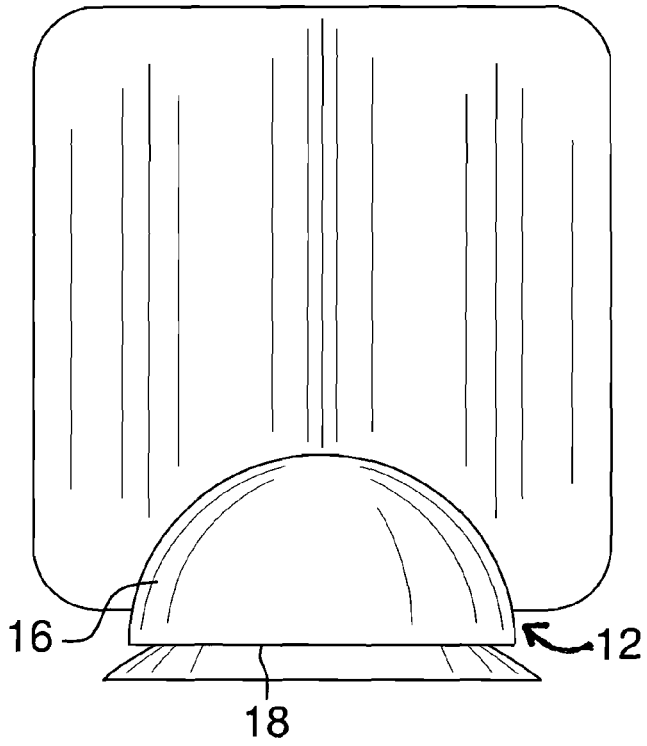
FIG. 4 is a side view of the present invention.
Figure 5:
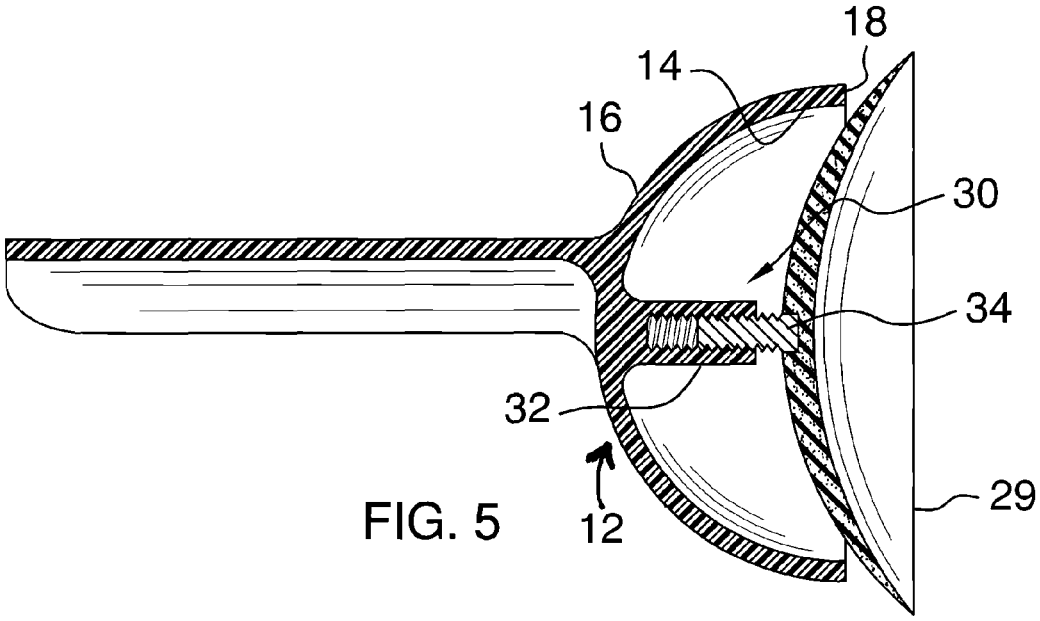
FIG. 5 is a cross-sectional view of the present invention taken along line 5-5 of FIG. 2.
Figure 6:
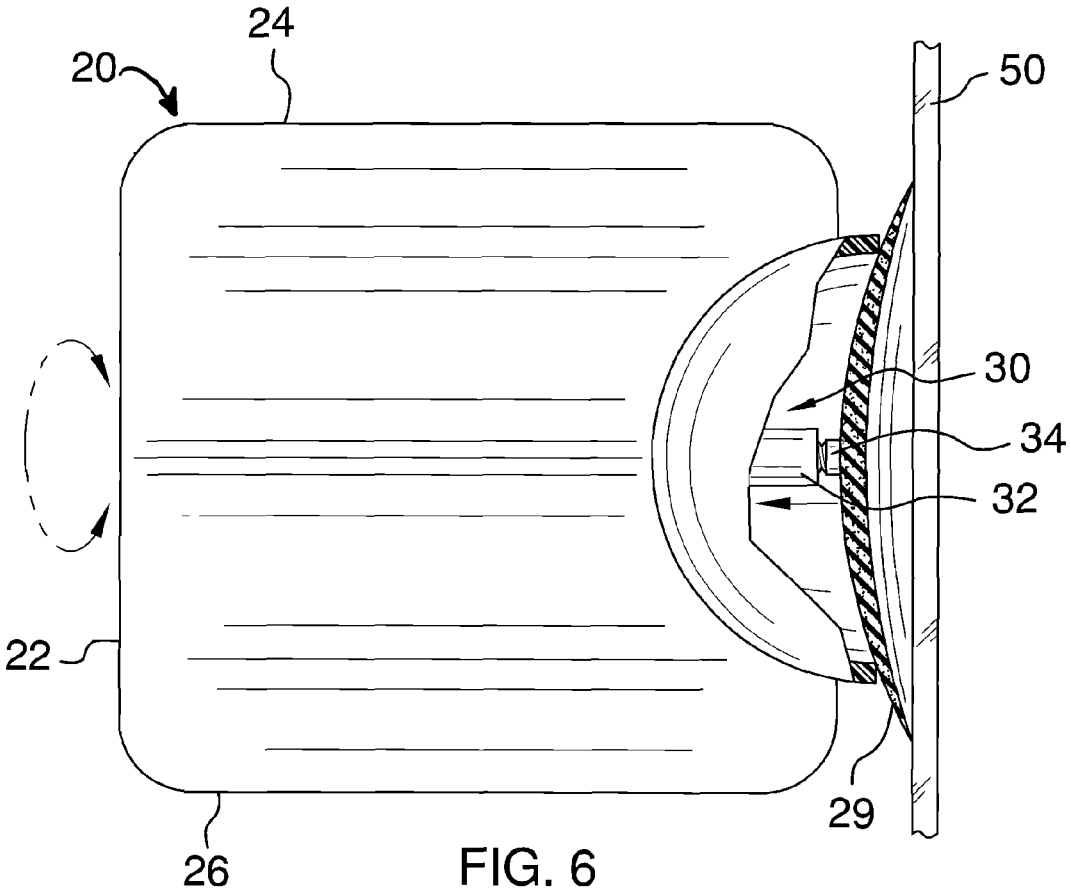
FIG. 6 is a cross-sectional in-use view of the present invention.
Figure 7:
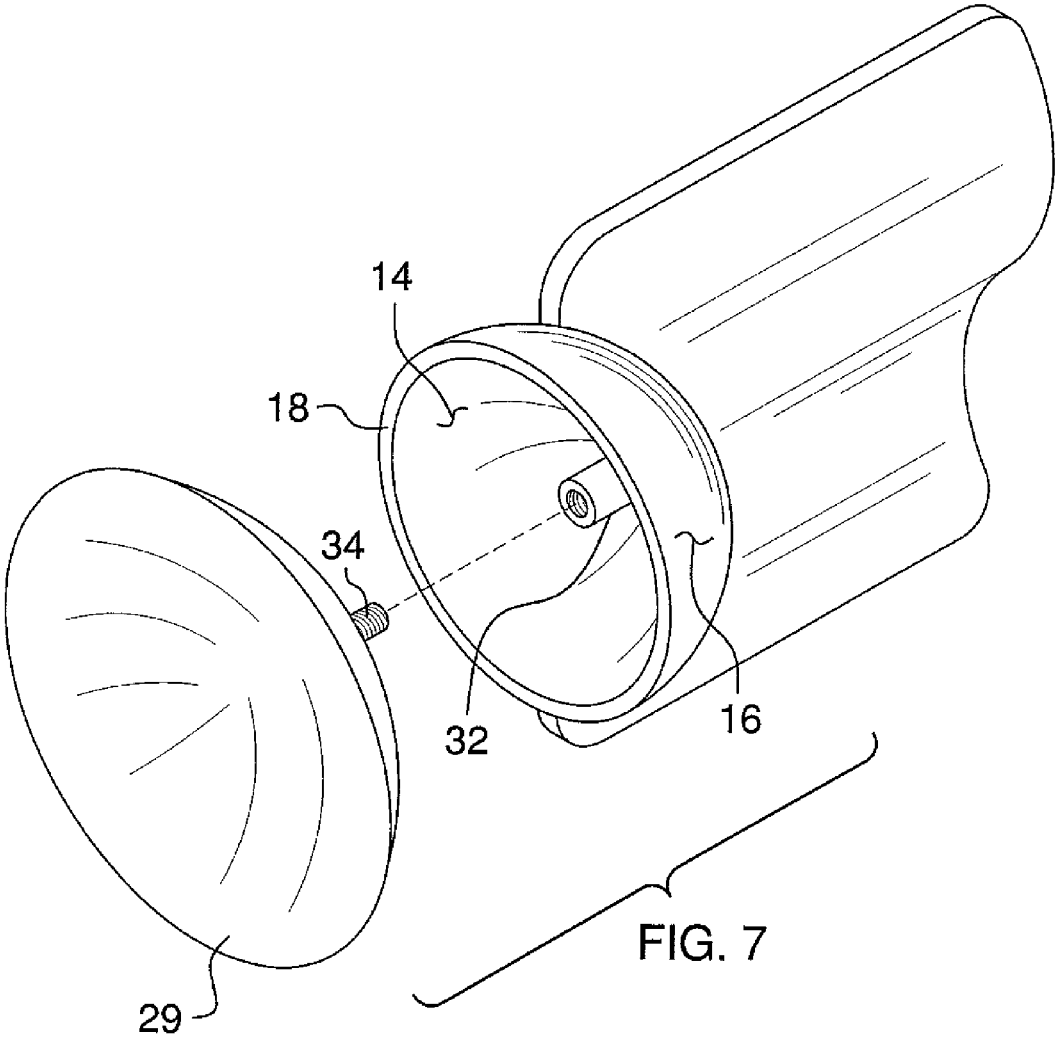
FIG. 7 is an expanded rear perspective view of the present invention.
Figure 8:
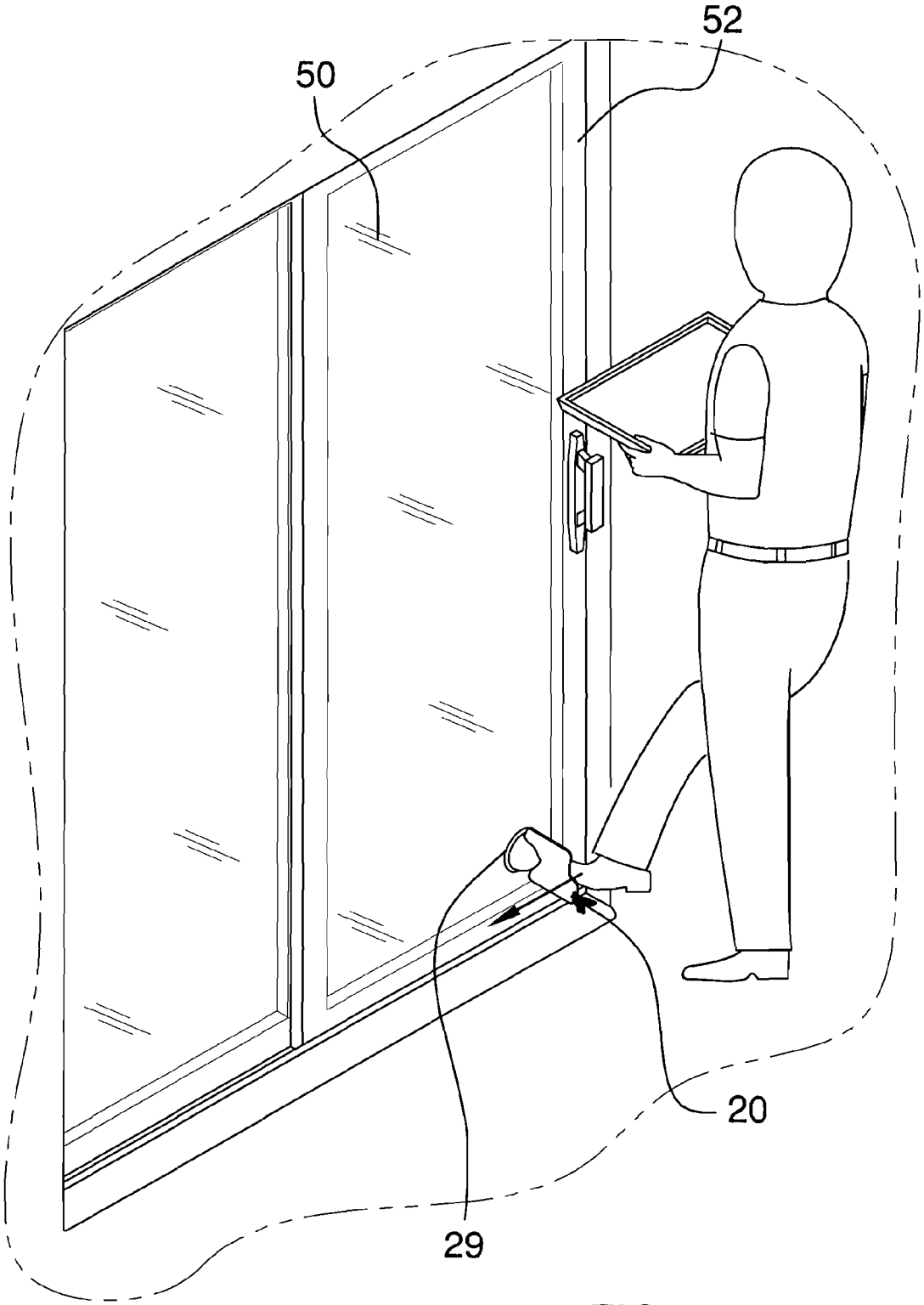
FIG. 8 is a perspective in-use view of the present invention.

With reference now to the drawings, and in particular to FIGS. 1 through 9 thereof, a new sliding door grip device embodying the principles and concepts of the present invention and generally designated by the reference numeral 10 will be described.

As best illustrated in FIGS. 1 through 9, the sliding door gripping apparatus 10 generally comprises a base 12 that includes a first side 14, a second side 16 and a perimeter edge 18. The first side 14 is concavely arcuate and the base 12 is comprised of a rigid material such as a plastic material.

Figure 9:
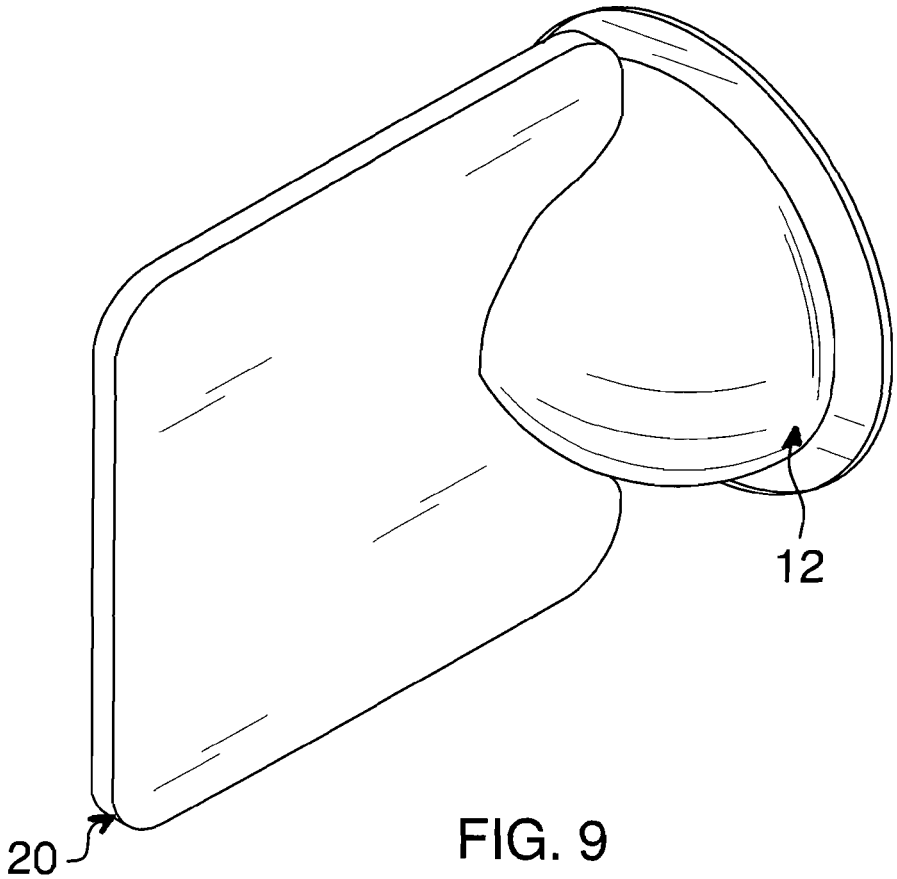
FIG. 9 is a front perspective view of a second embodiment of the present invention.

A panel 20 is attached to and extends away from the second side 16 of the base 12. The panel 20 has a distal edge 22 with respect to the base 12. The panel 20 includes a first side edge 24 and a second side edge 26 extending from the base 12 to the distal edge 22. In one version of the apparatus 10 shown in FIGS. 1-8, the panel 20 has a pair of opposite curves 28 therein from the first side edge 24 to the second side edge 26 to be wave shaped. This shape increases the friction between the panel 12 and person's appendage. Another version, shown in FIG. 9, depicts a planar panel 20. The panel 20 is comprised of a rigid material as well and may be integrally coupled to the base 12. The panel 20 has a length from the base 12 to the distal edge 22 between 2 inches and 6 inches. The panel 20 has a width from the first side edge 24 to the second side edge 26 between 3 inches and 6 inches.

A suction cup 29 is removably attachable to a glass surface 50 of a sliding door 52. A coupling assembly 30 couples the suction cup 29 to the first side 14 of the base 12 to allow the suction cup 29 to attach the panel 20 to the sliding door 52. The coupling assembly 29 includes a first mating member 32 attached to the first side 14 and a second mating member 34 attached to the suction cup 29. The first 32 and second 34 mating members are threadably coupled to each other. The suction cup 29 is pulled toward the first side 14 of the base 12 when the base 12 is rotated in a first direction with respect to the suction cup 29 to increase adhesion between the suction cup 29 and the sliding door 52 when the suction cup 29 is attached to the glass surface 50. This is caused by increasing the ratio of air pressure between the air located outside of the suction cup 29 to the air positioned between the suction cup 29 and the sliding door 52. The panel 20 is orientated approximately orthogonal to a plane of the sliding door 52 when the suction cup 29 is attached to the sliding door 52.

In use, the suction cup 29 is attached to the glass surface 50 of a sliding door 52 and the base tightened to the sliding door 52 by rotating the base 12 to pull the suction cup 29 into the open concave space between the suction cup 29 and the first side 14. The base 12 may also be rotated to ensure that the panel 20 is vertically orientated from the first side edge 22 to the second side edge 24. The panel 20 may then be abutted by a person's appendage, such as a foot or elbow, to open the sliding door 52 when the suction cup 29 is attached to the sliding door 52.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A grip apparatus being attachable to a sliding door, said apparatus including:

a base including a first side, a second side and a perimeter edge, said first side being concavely arcuate;

a panel being attached to and extending away from said second side of said base, said panel has a distal edge with respect to said base, said panel including a first side edge and a second side edge extending from said base to said distal edge, said panel having a pair of opposite curves therein from said first side edge to said second side edge such that said panel has a front side having a concavely arcuate surface followed by a convexly arcuate surface from said first side edge to said second side edge and a rear side having a convexly arcuate surface followed by a concavely arcuate surface from said first side edge to said second side edge;

a suction cup being removably attachable to a glass surface of the sliding door;

a coupling assembly coupling said suction cup to said first side of said base to allow said suction cup to attach said panel to the sliding door, said coupling assembly including only a first mating member attached to said first side and a second mating member attached to said suction cup, said first and second mating members being directly threadably coupled to each other, said suction cup being pulled toward said first side of said base when said base is rotated in a first direction with respect to said suction cup to increase adhesion between said suction cup and the sliding door when said suction cup is attached to the glass surface; and wherein said panel is abuttable by a person's appendage to open the sliding door when said suction cup is attached to the sliding door.

2. The apparatus according to claim 1, wherein said base and said panel are comprised of a rigid material.

3. The apparatus of claim 1, wherein said panel has a length from said base to said distal edge between 2 inches and 6 inches and a width from said first side edge to said second side edge between 3 inches to 6 inches.

4. The apparatus according to claim 1, wherein said panel is orientated orthogonal to a plane of the sliding door when said suction cup is attached to the sliding door.

5. A grip apparatus being attachable to a sliding door, said apparatus including:

a base including a first side, a second side and a perimeter edge, said first side being concavely arcuate, said base being comprised of a rigid material;

a panel being attached to and extending, away from said second side of said base, said panel having a distal edge with respect to said base, said panel including a first side edge and a second side edge extending from said base to said distal edge, said panel having a pair of opposite curves therein from said first side edge to said second side edge such that said panel has a front side having a concavely arcuate surface followed by a convexly arcuate surface from said first side edge to said second side edge and a rear side having a convexly arcuate surface followed by a concavely arcuate surface from said first side edge to said second side edge, said panel being comprised of a rigid material a suction cup being removably attachable to a glass surface of the sliding door;

a coupling assembly coupling said suction cap to said first side of said base to allow said suction cup to attach said panel to the sliding door, said coupling assembly including only a first mating member attached to said first side and a second mating member attached to said suction cup, said first and second mating member being directly threadably coupled to each other, said suction cup being pulled towards said first side of said base when said base is rotated in a first direction with respect to said suction cup to increase adhesion between said suction cup and the sliding door when said suction cup is attached to the glass surface, said panel being orientated approximately orthogonal to a plane of the sliding door when said suction cup is attached to the sliding door; and wherein said panel is abuttable by a person's appendage to open the sliding door when said suction cup is attached to the sliding door.

* * * * *